US006010348A

United States Patent [19]

Alden

[11] Patent Number: 6,010,348

[45] Date of Patent: Jan. 4, 2000

[54] FIELD-ASSEMBLED TWO-PIECE SNAP-FIT SELF-SEALED ELECTRICAL CONNECTOR

[75] Inventor: Peter H. Alden, Easton, Mass.

[73] Assignee: Alden Products Company, Brockton, Mass.

[21] Appl. No.: 09/081,270

[22] Filed: May 19, 1998

Related U.S. Application Data

[60] Provisional application No. 60/047,228, May 20, 1997.

[51] Int. Cl.[7] ..... H01R 13/52

[52] U.S. Cl. ..... 439/274; 439/681; 439/686

[58] Field of Search ..... 439/271, 281, 439/274, 275, 280, 286, 681, 686

[56] References Cited

U.S. PATENT DOCUMENTS

| | | | |
|---|---|---|---|
| 3,818,420 | 6/1974 | Barr | 439/274 |
| 4,166,664 | 9/1979 | Herrmann, Jr. | 439/271 |
| 5,222,909 | 6/1993 | Nomura et al. | 439/271 |
| 5,480,315 | 1/1996 | Martinelli | 439/271 |

*Primary Examiner*—Hien Vu
*Attorney, Agent, or Firm*—Donald W. Meeker

[57] ABSTRACT

A resilient tapered conical insert (40,70) is snap fit into a mating recess in each side of a two-piece multi-circuit connector (50, 80). A coupling body segmented latch arm (501, 801) expands over an insert ramp (410, 701) with segmented tabs (42, 82) and locks into an insert recess groove (402, 702) for a tactile and audible signal of engagement and a secure permanent union. Replaceable contact elements (20, 90) are snap fit in a fluid-resistant self-sealing relationship to selected mating openings (44, 74) in the inserts with a contact protrusion (22, 92) engaging an insert shoulder (140, 170) and contact barbs (23, 93) engaging resilient insert openings (145A, 171). A front contact barb (24, 94) snaps into a larger insert opening (45, 74) for a tactile and audible feedback of complete insertion. Replaceable inserts may be fitted with any desired configuration of paired contact elements assembled in the field. Blank or partially blank inserts (40B, 70B) may be drilled in the field.

15 Claims, 6 Drawing Sheets

70B
74B
74C
74A
40B
44B
44C
44A
46

100
20
90
30
31
35
37
33
81
89
38
82
803
88
9
71
72
73
74
7
79
63
65
64
60
177
75
76
70
78
805
85
184
802
801
80
83
36
300
10
55
154
57
56
53
59
52
501
505
9
45
49
42
43
41
35
44
47
48
46
51
58
50
200
40
22
23
24
26
20
96
94
92
93
90

FIELD-ASSEMBLED TWO-PIECE SNAP-FIT SELF-SEALED ELECTRICAL CONNECTOR

REFERENCES TO RELATED APPLICATIONS

This is a utility patent application based upon provisional patent application Ser. No. 60/047,228 filed May 20, 1997.

BACKGROUND OF THE INVENTION

1. Field of the Invention

The present invention relates to field assembled multi-circuit connectors for electrical wires, radio frequency cables, speaker wires, game control wires, phone wires, and other types of circuits, and in particular to a field assembled multi-circuit connector having snap-fit self-sealing components assembled without special tools, which may be changed for varying numbers, configurations, types and sizes of circuitry, using prefabricated circuit interchangeable housing inserts or blank inserts that can be custom made in the field and be snap-fit assembled with standardized coupling mechanism connector segments.

2. Description of the Prior Art

There is often a need to change the numbers, configurations, or sizes of multicircuit connectors to meet specific needs. Being able to make these changes in the field easily and without special tools is a great advantage to technicians and end users to meet specific and often unique custom connector needs quickly without waiting for the connectors or connector inserts to be manufactured or ordered and shipped to the site.

Connectors and circuits are often placed in hostile environments and it is necessary to seal the connectors against water and other environmental factors. Having a self-sealing field assembled connector would be a great advantage.

Most prior art devices rely on factory manufactured connectors or inserts for changing circuit configurations in the field. They generally require additional means such as epoxy, resins, or other sealants for sealing the circuit terminals, inserts, and other connector egresses.

U.S. Pat. No. 5,470,248, issued Nov. 28, 1995 and U.S. Pat. No. 5,542,856 issued Aug. 6, 1996 both to Wood, provide a field repairable electrical connector for underwater applications having a male member injection molded with the pins built in and a female member injection molded with the sockets built in, both of which are installed in the field by soldering the male and female members to the respective wires. They include an intermediary sealing member between the male and female members and a two-piece screw-together connector body to which both the male and female members are also screwed.

U.S. Pat. No. 3,885,849, issued May 27, 1975 to Bailey et al, shows electrical connectors with interchangeable components with different types of molded mating male and female inserts which are held by a releasable latching means into a two-piece housing which includes a strain relief cable clamp which acts as a ground.

U.S. Pat. No. 4,632,482, issued Dec. 30, 1986 to Punake et al, claims insertable and removable electrical contact pins retained and sealed against moisture by a one-piece molded rubber insert. The pins have two annular grooves with acutely angled flat surfaces and mating surfaces inside the rubber insert to retain and seal the pins.

U.S. Pat. No. 4,193,655, issued Mar. 18, 1980 to Herrmann, Jr., describes a field repairable connector assembly in which the terminals, terminal shells, and terminal inserts can be interchanged to provide a variety of connector configurations. Inserted pins and sockets are clipped into place and sealed with rubber sealing boots. The inserts are screwed into place.

U.S. Pat. No. 4,758,174, issued Jul. 19, 1988 to Michaels et al., discloses an environmentally sealed electrical connector having keyed elastomeric inserts frictionally retained in outer shells screwed together with a coupling nut. One of the inserts has a forwardly protruding deformable flange for sealing with the other insert.

None of the prior art inventions provide a field assembled multi-circuit connector with snap-fit self-sealing interchangeable and rearrangeable contact elements in standard interchangeable inserts or field fabricated custom inserts, which will accommodate a variety of sizes, configurations, and types of circuits, with the inserts snap-fit and self sealing in a pair of self-sealing coupling bodies.

The typical sealed contact assembly requires that the individual contacts be preinstalled into the contact insulator to achieve a seal. This type of contact packaging limits the assembly of wire or cable to a time-consuming hand soldering process.

SUMMARY OF THE INVENTION

The present invention provides a field assembled multi-circuit connector with snap-fit self-sealing interchangeable and rearrangeable contact elements in standard interchangeable inserts or field fabricated custom inserts, which will accommodate a variety of sizes, configurations, and types of circuits, with the inserts snap-fit and self sealing in a pair of self-sealing coupling bodies.

Snap/press fit installable contacts permit the assembler to hand cramp the contacts onto a wire before the contact is installed into the contact insulator, thereby eliminating the time-consuming hand soldering process. The snap/press fit installable contact process lends itself to possible automation.

An object of the present invention is to provide a fully field-assembled connector for variable multiple circuits by utilizing standardized connector coupling elements with readily interchangeable circuit housing inserts of either a preconfigured arrangement or with blank inserts that can be custom fabricated in the field.

One more object of the present invention is to provide a means for simplified assembly of the inserts with the coupling mechanism connector portions by means of an annular snap latch system. This invention utilizes segmented snap-latch arms as an integral feature of the coupling mechanism bodies that engage and become affixed within a circumferential ramp and latch recess located as a standard feature on the insert portion of the connector assembly.

It is further intended that by incorporating specifically differentiated slot engagement tabs to fit into correspondingly sized arm segment slots, that the inserts will be assembled in a consistent, keyed orientation with respect to the coupling body and the mating connector unit, and will thereby be secured from any inadvertent rotational misalignment during or after assembly.

Another object of the present invention is to provide a field-assembled connector which is self-sealing for protecting the connector parts from the environment and requiring no additional sealants or screw down componentry for the contact elements or the insert to housing interfaces.

One more object of the present invention is to provide a field-assembled connector with variable inserts each having an external conically tapered body contact surface, having an annular groove for an O-ring, which contact surface fits in a self-sealing relationship with a mating conically tapered internal surface inside the coupling body.

An additional object of the present invention is to provide a field-assembled self sealing connector with blank or partially blank inserts which may be custom configured in the field by drilling the necessary openings to accommodate any number, shape, type, and size of system connections utilizing pre-defined core geometries that are designed to accommodate various types of circuit connection elements. Special drill/router geometries may be specified to simplify core geometry.

A further object of the present invention is to provide contact elements which snap-fit in the openings of the inserts in a self-sealing relationship.

A related object of the present invention is to provide a protruding annular ridge on each contact element to engage a shoulder within the insert opening to prevent the contact element from being pulled out of the insert opening upon disconnection of the coupling bodies.

A related object of the present invention is to provide a barb feature on the contact elements used in relationship to an undersized hole section, such that upon forced passage therethrough, a positive tactile snap can be felt and heard as an indicator of full contact insertion and retention verification.

A contributory object of the present invention is to provide an annular barb feature on the contact elements that is used in relationship to an undersized hole section in the insert such that upon forced passage therethrough, the insert material deforms elastically allowing the barb portion to pass into a larger recess. This condition causes an audible and tactile snap-fit that provides positive verification to the installer of full contact insertion. The reformation of the undersized hole section behind the barb feature subsequent to insertion, provides positive entrapment of the contact element to resist pull out forces due to tension on the circuit or from push out forces during mating.

Another object of the present invention is to provide multi-circuit contact elements with multiple rearwardly angled annular shoulders that are larger in diameter than the insert openings into which the contacts are installed. The angled shape allows for lowered insertion forces to accomplish the press-fit during assembly while providing a highly resistive fit against pull out forces. The use of multiple shoulders also provides a redundancy in sealing against fluid invasion between the contact element and the insert.

One more object of the present invention is to provide a means for simplified assembly of the inserts with the coupling mechanism bodies by means of an annular snap-latch system consisting of segmented snap-latch arms as an integral part of the coupling bodies and a circumferential ramp, and latch recess as an integral design facet of the insert portions. It is further intended that by utilizing specifically differentiated slot engagement tabs to fit in matchingly sized arm segment slots that the inserts will be assembled in a repeatable keyed orientation with respect to the coupling bodies and the connector interface and will thereby be secured from any inadvertent relational misalignment during or after assembly.

An added object of the present invention is to provide multi-circuit contact elements with inserts which are keyed to the coupling bodies and coupling bodies keyed to each other to insure proper alignment of the plugs and receptacles.

An ensuing object of the present invention is to provide visual guides with mating lines on the coupling bodies and inserts to assist in connecting the parts into the proper keyed alignment.

Still another object of the present invention is to provide connector inserts which can accommodate contact elements for a multiplicity of circuits including electrical wires and cables, radio frequency cables, sound wires, game control wires, phone wires, and other circuits.

Yet another object of the present invention is to provide removable and replaceable contact elements for a field assembled connector.

An ancillary object of the present invention is to provide removable and replaceable pin and socket contact elements which snap-fit and self-seal into inserts which snap-fit and self-seal into coupling bodies for a field assembled electrical connector.

An auxiliary object of the present invention is to provide short pin and socket connection elements which are less expensive to make.

Another corollary object of the present invention is to provide resilient strain reliefs with internally tapered annularly ridged ends that mate with externally tapered ridged ends on the coupling bodies, so that the strain reliefs snap-fit onto the coupling bodies in a self-sealing relationship.

In brief, resilient plastic inserts are fitted with cylindrical insert openings to receive circuit contact elements, which connect to the circuits and then snap into the insert openings and are self-sealing therein due to protruding annular barbs from the contact elements, the barbs being larger in diameter than the openings, force fitting therein and sealing the contact element within the insert. The insert openings have internal shoulders to engage protruding annular ridges from the contact elements to prevent the contact elements from being pulled out of the coupling body.

Rearwardly angled annular barbs facilitate low installation forces while providing secure engagement with the insert body, simplifying field assembly requirements. A forward barb is accommodated in a clearance recess that provides tactile and audible feedback of complete insertion to the assembler.

Each insert has an exterior tapered conical body contacting portion with an annular groove with a resilient O-ring in the groove to provide a fluid resistant seal, to mate in a self-sealing relationship with an interior tapered conical surface in a body opening.

Each insert has an exterior circumferential recess groove located axially behind a ramped latch feature that is segmented by engagement tabs. Each coupling body has an annular segmented latch arm feature that engages in the aforementioned insert recess groove after being assembled in a telescoping manner with the latch arms being expanded over the ramp feature and subsequently locking into the recess groove. Once engaged in the recess groove, the latch arms provide a locking feature, creating a secure sealed and fixed permanent union between the insert and the coupling body or housing. The segmenting slots in the latch arms are specifically sized such that proper orientation is attained by their correct alignment with the correspondingly sized insert tabs.

Each insert has a series of notches around the outer periphery which mate with keys inside the coupling body when a line marked on the outside edge of the insert is aligned with a mating line marked on the outside edge of the coupling body when the insert is snap-fit into the coupling body.

The coupling bodies are provided with tapered circuit receiving ends having external annular ridges. Flexible strain reliefs with an internal mating tapered opening having mating annular ridges snaps onto the coupling body for a self-sealing fit. The coupling bodies have mating self-sealing coupling faces keyed together for proper orientation. Mating lines on the exterior of the coupling bodies assist in the proper keying alignment.

An advantage of the present invention is that the multi-circuit connector components snap fit together in self-sealing relationship to form a multi-circuit connector that is sealed from the environment.

Another advantage of the present invention due to the two part design separating the circuit carrying insert from the coupling body is that the outer body may be made of a conductive material or plated with a conductive substance in order that a shielded cable may be simply attached to the circuit opening end during assembly to create a completely shielded composite connector that may be cost effectively fabricated and is shielded against electromagnetic interference and radio frequency interference.

Another advantage of the present invention is that end users and technicians can create and install the required connection configurations in the field without requiring special tools.

Yet another advantage of the present invention is that contact element types, sizes, and configurations can be changed quickly and easily in the field.

An additional advantage of the present invention is that expensive electrical pin and receptacle sockets are small in size to reduce material costs and can easily be replaced in the field if damaged for simplified field maintenance.

Additionally, panel mounted receptacles may be installed in the panel hardware at any time, and the wire terminations and assembly into the insert may be assembled independently to the cable terminations allowing for optimized production methodology, at which point the insert may be installed in the panel mount coupling body from the panel interior, negating the need to feed wires through the panel cutout prior to assembly and hardware connection, as is typical with most connector systems.

These and other features, objects and advantages will be understood or apparent to those of ordinary skill in the art from the following detailed description of the preferred embodiment as illustrated in the various drawing figures.

BRIEF DESCRIPTION OF THE DRAWINGS

FIG. 1 is an exploded perspective view of the all of the components of the invention aligned for assembly with a pin and socket contact element which could be used to interconnect circuits having electrically conducted signals such as electrical wires and cables, speaker wires, game control wires, telephone wires, radio signal wires, and the like;

FIG. 1A is an expanded elevation view of a pair of contact elements;

FIG. 2 is a perspective view showing a pair of inserts which may be drilled out with insert openings for various sizes, types, and configurations of contact elements;

DETAILED DESCRIPTION OF THE PREFERRED EMBODIMENT

Figures 1, 1A, 2:
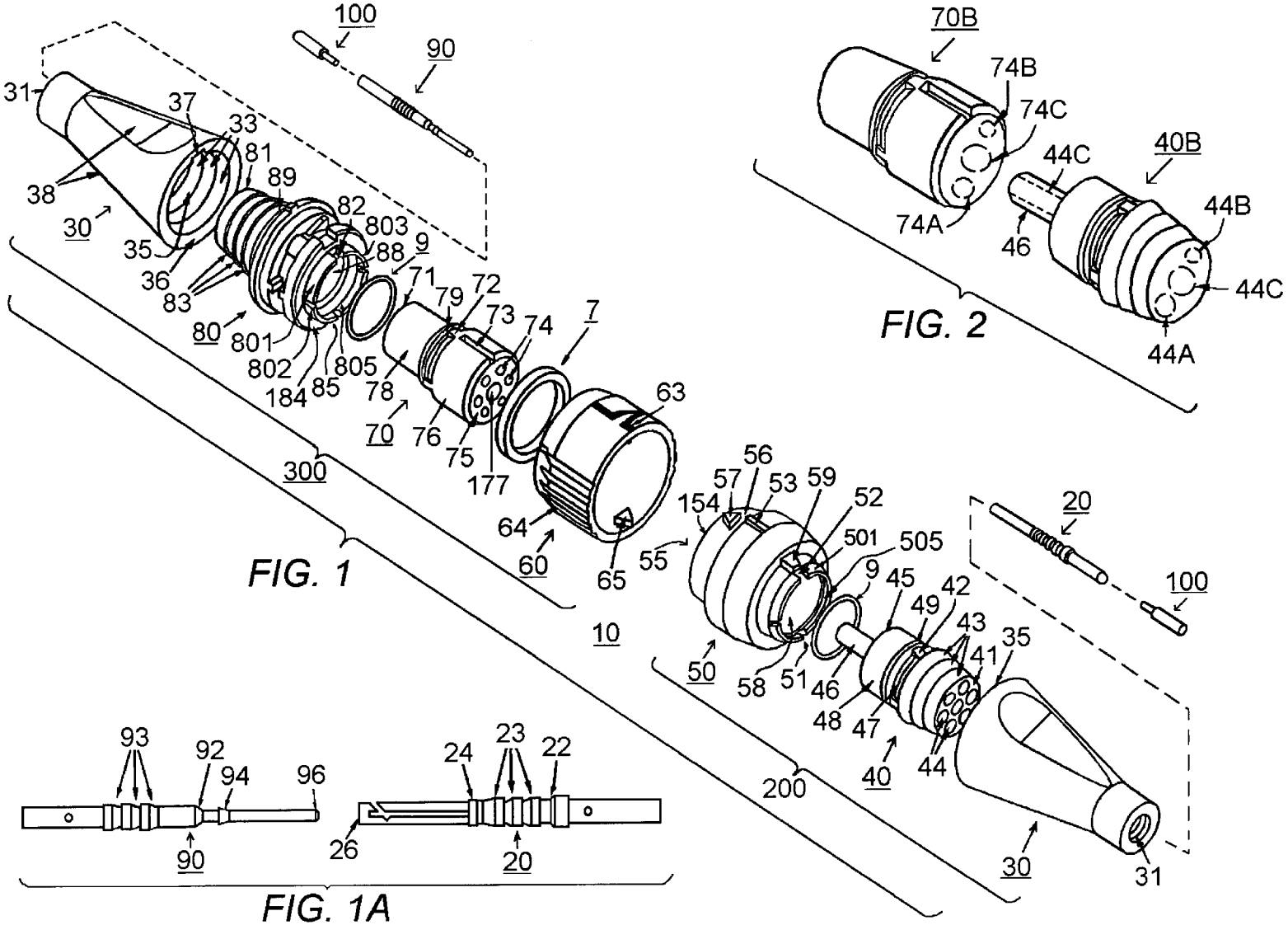
Figure 4:
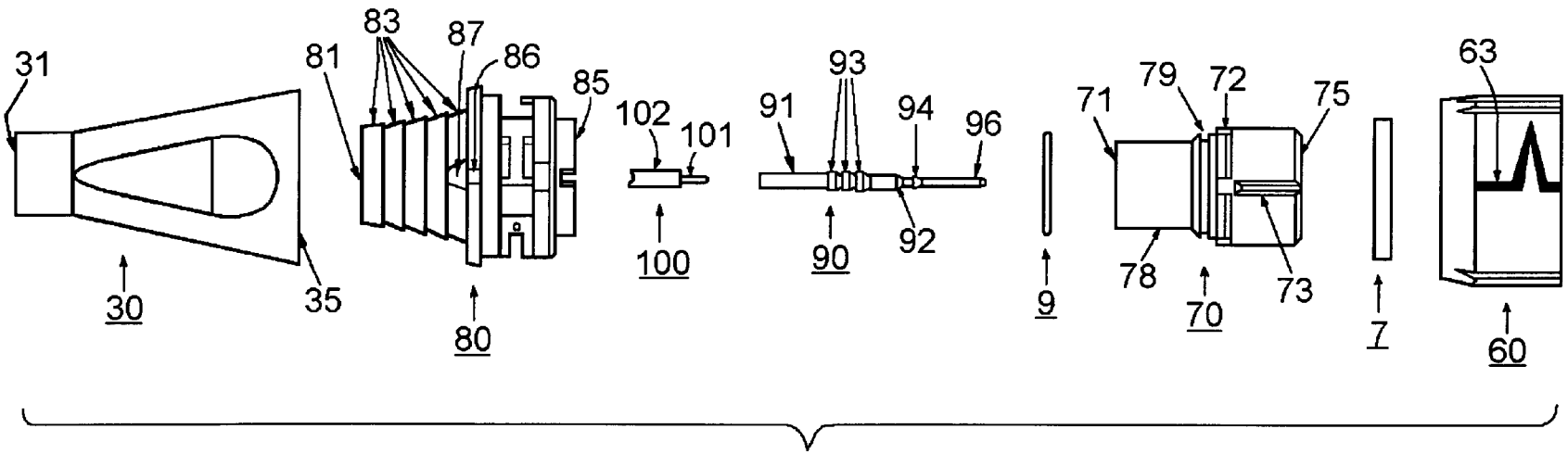
FIG. 4 is an exploded elevation view of the plug components of the inline embodiment of the invention aligned for assembly.
Figure 5:
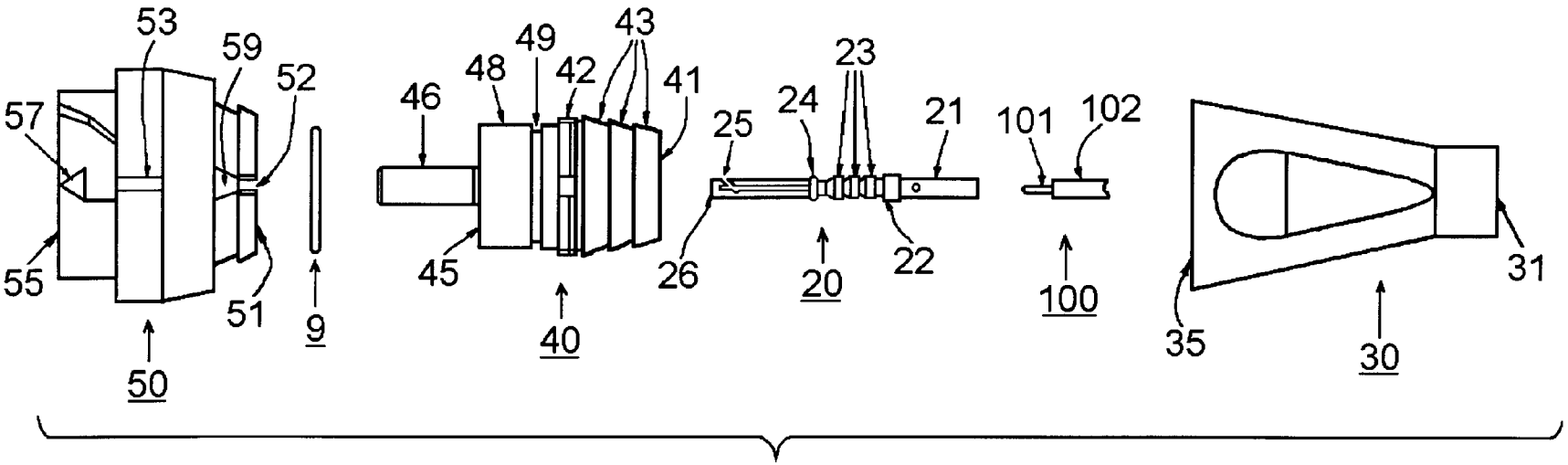
FIG. 5 is an exploded elevation view of the receptacle components of the inline embodiment of the invention aligned for assembly.

In FIGS. 1, 4, and 5 a self-sealing composite connector 10 has snap-fit self-sealing field assembled components to interconnect a multiplicity of pairs of circuits 100 of any desired type through a multiplicity of paired contact elements 20 and 90 which can be arranged in any desired configuration snap fit into inserts 40 and 70, respectively, within the coupling bodies 50 and 80 of the in-line receptacle 200 and the plug and coupler 300, respectively. Together with the alternate panel mount receptacle 400, these units constitute the main elements of the self sealing, two-piece connector 10.

A pair of coupling bodies 50 and 80 each have a body opening 51, 55 and 81, 85, respectively, therethrough and a coupling means as described in U.S. Pat. Nos. 5,167,522 and 5,067,909 both issued to Behning and assigned to Alden Products Company, including a coupling sleeve 60 having internal camming tabs 65, interacting and mating with circumferential ramps 56 and camming tabs 57 on the coupling body 50, and aligning means including the coupling body external axial tab 53, or aligning tab, and the coupling sleeve external graphic line 63, or visual aligning guide for forming a sealed aligned connection between the coupling bodies with the body openings in mutual communication.

The inserts 40, 40A, 40B, and 70, are attached to the coupling bodies 50, 50A and 80 by a series of segmented annular snap-latch arms 501, 501A and 801 located around the periphery of the circuit openings 51, 51 A and 81, respectively. These segmented annular snap-latch arms 501, 501A and 801 feature a latch engagement projection 505, 505A and 805 that becomes engaged in the segmented circumferential engagement recess slots 402, 402A and 802 after the inserts are telescopingly assembled with the coupling bodies 50, 50A and 80 respectively.

Figure 9A:
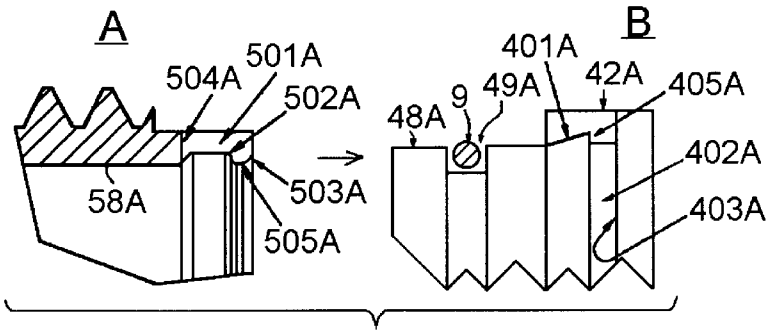
FIG. 9A is an enlarged exploded partial cross-sectional view of the panel mounted receptacle components of FIGS. 3 and 9 showing the snap latch feature details A and B circled in FIG. 9.
Figures 7, 8, 8A, 9:
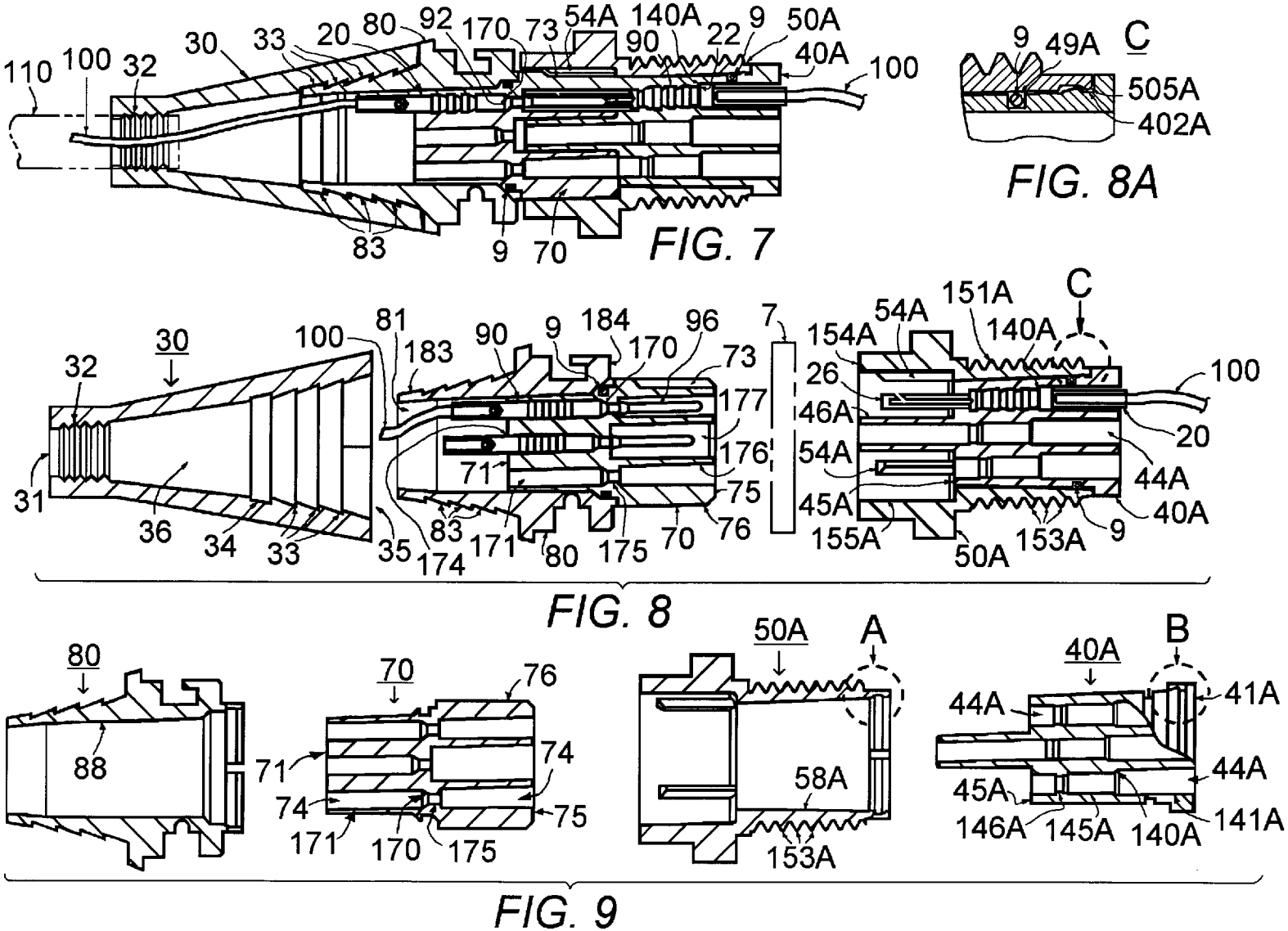
FIG. 7 is a cross-sectional view of the panel mount receptacle and in-line plug embodiment of the invention fully assembled and engaged, shown without the coupler element for clarity.
FIG. 8 is an exploded cross-sectional view of the panel mount receptacle and inline plug embodiment of the invention with the inserts mounted in the two coupling bodies and the coupling bodies aligned for connection and the strain relief aligned for assembly.
FIG. 8A in an enlarged partial cross-sectional view of the panel mount embodiment of FIG. 8 showing the snap latch feature and O-ring seal in the assembled position from the detail C circled in FIG. 8.
FIG. 9 is an exploded partial cross-sectional view of the inserts and coupling bodies of the panel mount receptacle and in-line plug embodiment of the invention aligned for assembly.

During assembly of the inserts 40, 40A and 70, an O-ring 9 is installed in the annular groove 49, 49A and 79 respectively. As the inserts reach full engagement with the coupling bodies, the segmented annular snap-latch arms are elastically deformed radially outward as they are forcibly expanded by traversing up the segmented circumferential latch ramp 401, 401A and 701, as best seen in FIG. 9A. Upon full engagement, the latch engagement projection feature 505, 505A and 805, drops into the segmented circumferential engagement recess slot 402, 402A and 702, respectively, as best seen in FIG. 8A, thereby providing a permanent and sealed engagement with a tactile and audible signal of engagement. At this point the insert is securely locked to the coupling body by the vertical shoulder of the latch ramp back surface 405, 405A and 705 abutting the opposing vertical surface of the latch arm back edge 502, 502A and 802, thereby preventing axial separation of these two components.

Figure 3:
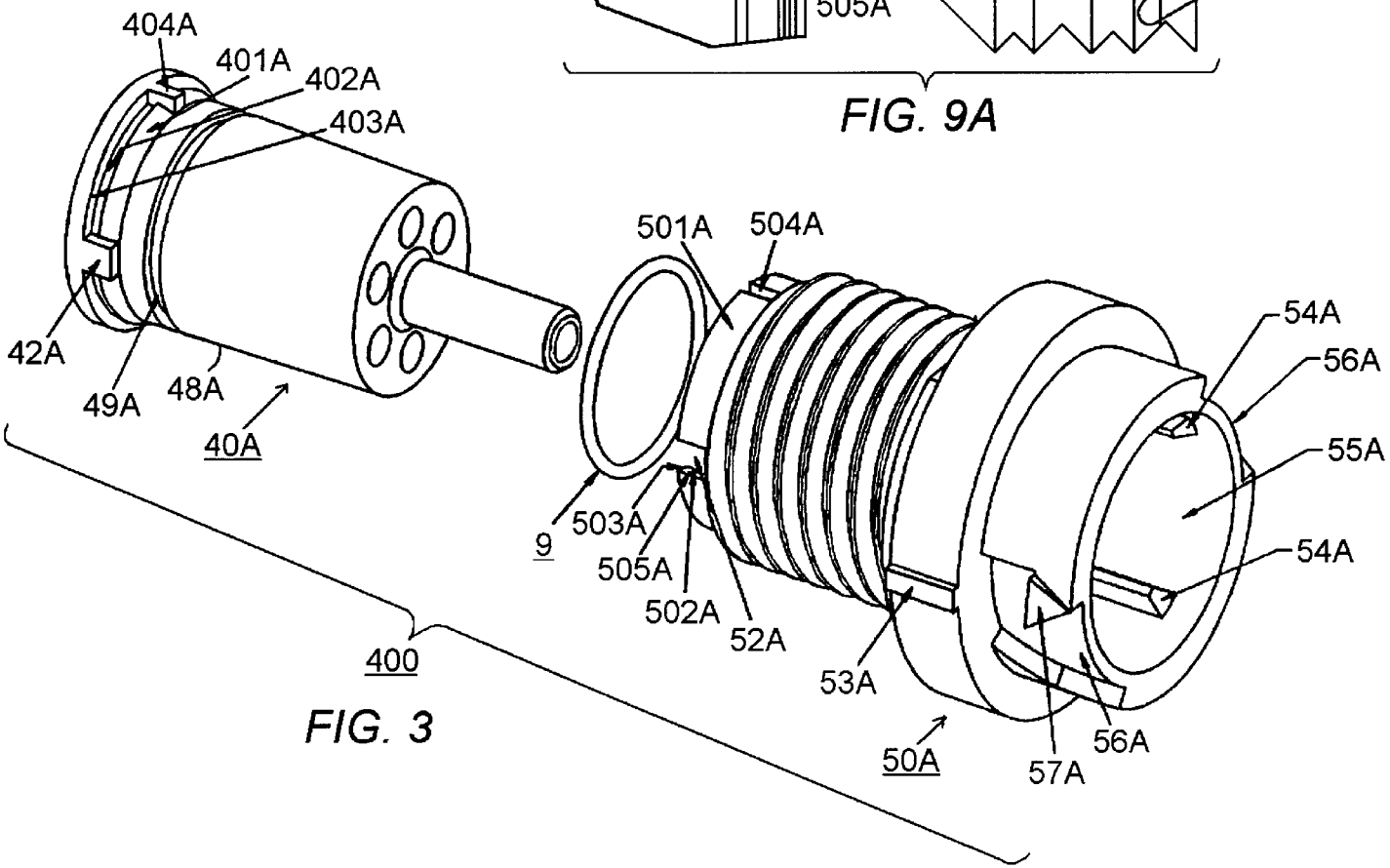
FIG. 3 is an exploded perspective view of the panel mounted receptacle components of the invention aligned for assembly; with an expanded detail of the snap latch features.

Additionally, the inserts 40, 40A and 70 are oriented with respect to the coupling bodies 50, 50A and 80 by means of engaging the peripheral tabs 404, 404A and 804 and the enlarged peripheral keying tab 42, 42A and 82 into the correspondingly sized peripheral anti-rotation engagement slots 504, 504A and 804 as well as the enlarged peripheral keying slot 52, 52A and 82, during assembly, as best seen in FIG. 3. Engagement of these features ensures proper alignment as the inserts and coupling bodies can only be assembled if these tabs and slots are properly positioned. Once engaged, the interlock of these features prevents any rotational movement of the insert with respect to the coupling body.

The pair of mating inserts 40 and 70, each having a self-sealing snap-fit means of securing to the pair of coupling bodies 50 and 80, respectively, and each of the inserts having a tapered conical body-connecting surface 48/48A and 78, respectively, with an annular groove 49/49A and 79, respectively, is each inserted within the body opening of one of the coupling bodies 50/50A and 80, respectively, and sealed therein with a snap self-sealing fit against a mating tapered conical surface 58/58A and 88, respectively, inside the coupling bodies 50 and 80, as best seen in FIGS. 1, 3, 9A, and 8A, and aligned therein by the aforementioned keying means. A resilient O-ring 9 fitting within the O-ring grooves 49, 49A and 79, serves to seal each of the inserts with its respective coupling body against fluid migration between the insert and coupling body when the connector is unmated.

The coupling body assemblies 200/400 and 300 are keyed to each other by internal axial ridges 54/54A in one of the coupling bodies 50/50A in one coupling body assembly 200/400 engaging external slots 73/73A on the insert 70/70A in the other coupling body assembly 300, as best seen in FIGS. 7 and 8, as well as by the coupling means described above and in the referenced patents to insure proper alignment of the mating configurations of pins 90 and receptacles 20.

Visual guides using graphic lines 63 or visible protrusions 53 in mating alignment on the inserts 40 and 70, coupling bodies 50 and 80, and coupling collar 60, as well as the coupling graphics described in the referenced patents, further assist in connecting the parts into the proper keyed alignment.

In FIGS. 7, 8, and 9, the inserts 40A and 70 have a multiplicity of pairs of aligned insert openings or passages 44A and 74 therethrough with a protruding shoulder 140, 140A and 170 within each of the insert openings 44A and 74 formed by a larger hole 141A, and 171, cored through the insert connecting end 41A and 71 to a set depth, at which point the cored hole transitions to a smaller diameter hole 145A and 175, thereby creating the protruding shoulder 140A and 170. The smaller hole section in the plug insert 70 also provides for a snap-fit with the contact element 90. The forward annular barb 24 and 94 is larger in diameter than the smaller hole section 146A and 175, such that the barb 24 and 94 must elastically deform the material in this section as it is forced through. Upon full insertion, the barb reaches the front insert opening 45 and 74 that is larger than the barb. This transition creates a tactile and audible snap-fit effect, providing verification to the assembler that the contact element 20 and 90 is fully inserted and secured. Additionally, the deformation of the smaller hole 146A and 175 material behind the bard 24 and 94 thoroughly entraps the contact element, thereby securing the element from pull-out from tensions exerted on the circuit or push-out forces from mating. The same configuration of the openings and contacts applies to the configurations of FIGS. 1–6.

In FIGS. 1A, 7, 8, and 9, the contacts have a forward angular barb 24, 94 that snaps through the protruding shoulder 140/140A and narrowed opening 145A into an annular notch 146A in the receptacle insert 40/40A and through on the plug insert shoulder 170 and narrowed opening 175 into the wider insert opening 74 in the plug insert 70, thereby causing a tactile felt snap verifying full contact insertion and secure retention of the contacts in the inserts.

Additionally, the contact elements (contacts) 20 and 90 have a multiplicity of protruding annular barbs 23 and 93 that are sized such that the barbs are larger in diameter than the small hole sections 145A and 171 respectively thereby forcing material displacement during assembly and forming a seal between the contact elements (contacts) 20 and 90 and the insert bodies 40 and 70, respectively. The rearwardly pointing angles on the barbs promote low insertion forces and minimize excessive material disruption of the insert bodies 40 and 70 while the vertical back edge provides for raised resistance to inadvertent push-out forces or pull-out forces transmitted through tension on circuit conductors 101 or other forces that can be exerted on the contact elements toward the insert openings.

In FIG. 2 each of the pair of inserts 40A and 70A is configured by providing a blank or partially blank insert 40A and 70A to allow the formation of at least one of the pairs of insert openings 44A and 74A, 44B and 74B, 44C and 74C (all shown dashed) therein by a drilling means performable in the field with a standard preconfigured drill or router.

A multiplicity of pairs of contact elements 20 and 90 have mutually mating connecting ends, a receptacle end 26 (or socket) and a plug end 96 (or pin) respectively. Each of the contact elements 20 and 90 has one annular protruding annular barb 24 and 94, respectively, for snap fitting the contact element into the insert opening 44 and 74, respectively, countered by the positive stop of the protruding annular ridge 22 and 92 to engage the shoulder 140 and 170, respectively of the insert opening to prevent the contact element from being pulled out of the insert opening 44 and 74 by the force of the contact elements being disconnected. The pairs of contact elements 20 and 90 snap fit into the pairs of insert openings 44 and 74 arranged to form a desired configuration of pairs of mating contact elements, so that when the coupling bodies 50 and 80 are coupled and aligned together by the coupling and aligning means, the pairs of contact elements 20 and 90 connect together through a telescoping motion and the pair of inserts 40 and 70 mate at the insert mating end 45 and 75, respectively, with a self-sealing connection to seal the contact elements therein, as seen in FIG. 7.

In FIGS. 1, 7, and 8 the means for mutually aligning and self-sealing the mating ends of the inserts together comprises having a mating end cylinder 76 of one of the inserts 70 protruding from one of the coupling bodies 80 and having the connecting end 96 of the contact element 90 recessed within the protruding mating end head 76, and having an enlarged insert opening mouth 176 around the recessed contact elements with the connecting end 96 of each of the contact elements 90 positioned within the insert opening mouths 176. The insert opening mouths 176 are adapted to receive the connecting ends 26 of the contact elements 20 from the other insert 40 inserted therein with a telescopingly frictionally engaging self-sealing connection with the connecting ends 26 and 96 of the contact elements 20 and 90 mating in a tight friction fit therein, as seen in FIG. 7. The other insert 40 is recessed within the other coupling body 50 or 50A to leave a coupling body extension 155 extending beyond the other insert and the connecting ends 26 of the other contact elements 20 protruding a distance from the other insert less than the coupling body extension so that the protruding contact elements 26 are shielded by the coupling body extension 155. The mating end head 76 is formed into a tapered frustoconical shape and the coupling body extension 155 of the other coupling body 50 or 50A is structured with a mating internal tapered frustoconical opening to receive the mating end head 76 therein with a self-latching sealed connection, the mating end faces 45 and 75 of the two inserts contacting and sealing together due to the resiliency of the inserts, sealing all the contact elements therein. Inserts may also be made of a rigid material for certain applications in which case, a gasket 7 is located against the plug sealing surface 184 and is compressed by the receptacle leading edge 154/154A, as seen in FIGS. 1 and 8, thereby forming an interface seal.

A protruding finger 46 from the recessed insert 40 which finger is longer than the protruding connecting ends 26 of the other contact elements 20 to shield the protruding connecting ends 26, and shorter than the coupling body extension 155, and a mating tapered frustoconical opening 177 in the protruding mating end head 76 of the other insert 70 adapted to receive the protruding finger 46 with a tight cylindrical fit therein, further aiding in concentric alignment of the connector assemblies together. The protruding finger 46 further comprises a rigid extension that serves to reduce access to the connector interior in order to prevent inadvertent entry of fingers and/or probe type devices that could cause possible damage to the exposed contact elements 26 within the coupling body extension 155. Other insert 40A, 70A configurations may or may not utilize this feature, depending on the type and configuration of the circuitry being accommodated.

Figure 6:
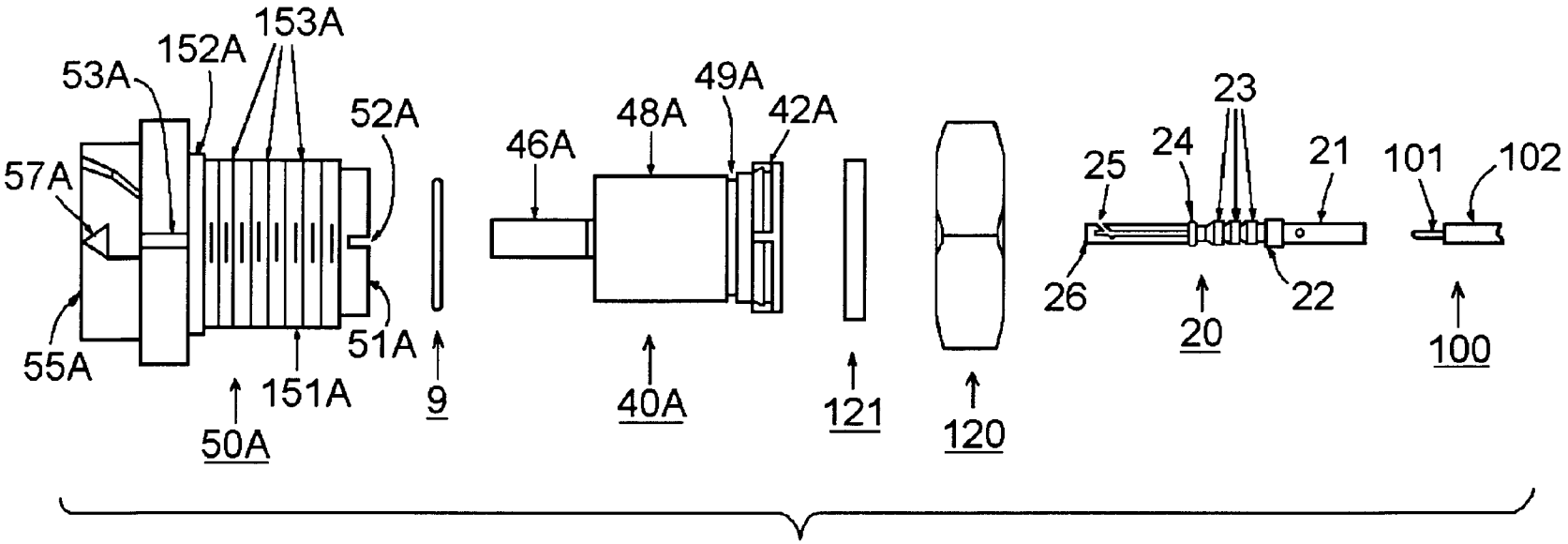
FIG. 6 is an exploded elevational view of the receptacle components of the panel mount embodiment of the invention aligned for assembly.

In FIGS. 1, 6 and 7 at least one coupling body 80 of the pair of coupling bodies has an inline circuit connecting end 181 for receiving circuits 100 therein, the coupling body inline circuit connecting end comprising a tapered frustoconical surface 183 having a series of external annular barb-type ridges 83 protruding therefrom and a circuit opening 81 to admit the circuits therein; and further comprising a strain relief 30 of flexible material having a circuit opening 31 therethrough to admit circuits, the strain relief structured with an internal mating tapered frustoconical surface 34 having mating annular barb-type ridges 33 radiating inwardly so that when the strain relief 30 is snap fit onto the coupling body inline circuit connecting end 181, the mating barb-type ridges 33 and 83 interlock to secure the strain relief to the coupling body with a self-sealing interconnection between both the coupling body 80, the strain relief 30 and the circuit 100 of cable 110 by means of resiliently compressed labyrinth-type ridge seals 32 at the circuit opening, the ridge seals 32 being compressed by the cable to form a seal therebetween. Additionally, the interlock of the mating barb-type ridges 33 and 83 provide a pull-off resistant connection to secure the circuit 100 to the connector assembly. The interlock of the mating barb-type ridges 33 and 83 are retained under a preloaded condition by the compression of the tapered leading edge 36 of the strain relief 30 against the rear barrier shoulder 58 and 88 on the coupling bodies 50 and 80. The tapered leading edge 36 also promotes enhanced sealing by concentrating the resilient compression at the outer edge of this junction. This method also prohibits this interface from losing its seal when the strain relief 30 is subjected to transverse loads. Additionally, the strain relief 30 is oriented with the grid surfaces 38 on top and bottom and is restrained from rotational movement by engagement of the tapered key 59 and 89 inside the strain relief keyway slot 37.

In FIG. 3, the inserts 40, 40A, and 700 are oriented with respect to the coupling bodies 50, 50A, and 80 bi means of engaging the peripheral tabs 404, 404A, and 804 and the enlarged peripheral keying tab 42, 42A and 82 into the correspondingly size peripheral anti-rotation engagement slots 504, 504A and 804 during assembly. This engagement ensures proper alignment as the inserts and coupling bodies can only be assemble if these tabs and slots are properly positioned. Once engaged they prohibit any rotational movement of the insert with respect to the coupling body.

In FIG. 1 one coupling body 50 of the pair of coupling bodies has an insert 40 with an insert inline circuit connection end 41, opposite the mating end, for receiving circuits therein, and the insert inline circuit connection end 41 protrudes out of the one coupling body 50, the insert inline circuit connecting end 41 comprising a tapered frustoconical surface having a series of external annular barb-type ridges 43 protruding therefrom and a circuit opening 44 to admit the circuits therein; and further comprising a strain relief 30 of flexible material having a circuit opening 31 therethrough to admit the circuits, the strain relief 30 structured with an internal mating tapered frustoconical surface 34 having mating annular barb-type ridges 33 radiating inwardly so that when the strain relief 30 is snap fit onto the insert inline circuit connecting end 41, the mating ridges 33 and 43 interlock to secure the strain relief to the insert and coupling body with a self-sealing interconnection.

In FIGS. 5–8 one coupling body 50A of the pair of coupling bodies has a panel mount end 151 having an exterior threaded surface 153 to receive a securing nut 120 and washer 121, and the insert 40B of the one coupling body.

Any combination of types, sizes, and configurations of contact elements may be used in the same circuit to convey signals or mediums such as electricity, fiber optic light or various fluidic mediums. The contact elements may be used in either of the coupling bodies of the multi-circuit connector, so that either coupling body may have pin or socket contact elements or a combination of both providing that the appropriate mating contact element is positioned opposite in the other coupling body for interconnection therewith.

Another embodiment of the present invention will utilize inserts 40, 40A and 70 fabricated from a resiliently deformable material. The embodiment of this invention will eliminate the need for supplementary sealing O-rings and gaskets as the inserts will be configured to provide sealing at the connector interface and between the inserts and the coupling bodies as well as the contact elements.

Still another embodiment of this invention will employ either conductive material or plating on the coupling bodies and coupler, thereby facilitating provision for a simple and cost effective composite shielded connector that is shielded against electromagnetic interference and radio frequency interference.

Although the present invention has been described in terms of the presently preferred embodiment, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A multi-circuit connector having snap-fit self-sealing field-assernbled components to interconnect a plurality of contact elements which can be arranged in some desired mating configuration, the contact elements snap fit into mating inserts within the multi-circuit connector, the multi-circuit connector comprising:

a pair of mating coupling bodies each having a body opening therethrough, an aligning tab, an annular snap latch, a series of key slots;

a self-sealing coupling sleeve for forming a sealed aligned connection between the coupling bodies with the body openings in mutual communication, the coupling sleeve having a visual aligning guide on the outer surface of the coupling sleeve;

a pair of mating inserts, each formed of a resilient material, each having a mating end, and each insertable in the body opening of one of the coupling bodies, each of the mating inserts having a tapered conical surface at the mating end of each of the mating inserts, each of said conical surfaces having a self-sealing O-ring groove therein, an annular slot for receiving the annular snap latch of the coupling body to provide a snap fit, and a series of segmenting key tabs in each of the pair of inserts to insert in the mating series of key slots in each of the coupling bodies for engaging the body opening, the inserts each having a resilient mating end face for mutually aligning, engaging, and self-sealing the mating end faces together, and the inserts each having a plurality of insert passages therethrough aligned with a plurality of insert passages in the other insert, the pairs of aligned insert passages being of various desired diameters and positioned as desired in mating configurations within the mating inserts;

the plurality of paired contact elements, each of the paired contact elements capable of being secured in the insert passages and being mutually aligned, and each of the paired contact elements having a mutually mating connecting end, each of the contact elements having at least one friction fitting barb for engaging in each of said passages, said engagement between each contact element and each passage being a self-sealing snap fit, so that when the coupling bodies are aligned and coupled together, the paired contact elements in the pair of mating inserts are capable of being connected together and the resilient mating end faces self-sealing together to seal the paired contact elements therein, thereby providing in a simplified assembly of the inserts with the coupling bodies with no assembly tools required.

2. The multi-circuit connector of claim 1 wherein each of the inserts further comprises a ramped latch feature on the conical surface adjacent to the annular slot, the ramped latch feature being segmented by a series of engagement tabs, the series of annular snap latch arms of each of the coupling bodies being capable of engaging in the circumferential groove after the insert is inserted into the coupling body in a telescoping manner with the series of annular snap latch arms capable of being expanded over the ramp feature and subsequently locking into the circumferential groove to provide a tactile and audible signal of engagement of the latch arms in the recess groove, which engagement secures the insert within the coupling body in a fashion that provides a permanent and sealed assembly of the insert and the coupling body.

3. The multi-circuit connector of claim 2 wherein the latch arms have a series of segmenting slots which are specifically sized such that proper orientation is attained by their correct alignment with the correspondingly sized series of insert tabs, the insert being provided with an insert line marked therein, and the coupling body being provided with a mating coupling line outside the coupling body, the series of segmenting slots being capable of mating with the series of mating insert tabs when the insert line is aligned with the mating coupling line when the insert is snap-fit into the coupling body.

4. The multi-circuit connector of claim 3 wherein the O-ring groove comprises an annular groove in the tapered conical surface and further comprising an O-ring insertable in the annular groove of the tapered conical surface, the O-ring forming a fluid resistant seal between the tapered conical surface of each of the inserts and the mating tapered conical body opening inside the coupling body.

5. The multi-circuit connector of claim 1 wherein the pair of inserts is configured to allow the formation of at least one of the pairs of insert openings therein by a drilling means capable of being performed in the field with a standard drill.

6. The multi-circuit connector of claim 1 wherein each of the pairs of insert passages comprises a smaller hole in the mating end of the insert passage and a larger axially aligned hole in the other end meeting the smaller hole within the insert passage to form a shoulder between the two holes.

7. The multi-circuit connector of claim 1 wherein the mating end of a first insert protrudes from a first coupling body and the first insert further comprises an enlarged insert passage mouth in each of the insert passages on the mating end face of the first insert, the connecting end of each of the contact elements being recessed within one of the insert passage mouths, and the insert passage mouths are adapted to receive the connecting ends of the contact elements from a second insert inserted with one of the connecting ends from the second insert in each of the passage mouths of the first insert with a frictionally engaging self-sealing connection, the connecting ends of the contact elements mating in a tight friction fit therein, and a second coupling body connected to the second insert further comprises a coupling body extension extending beyond the second insert the second insert recessed within the coupling body extension and the connecting ends of the contact elements of the second insert protruding a distance from the mating end of the second insert less than the coupling body extension so that the contact elements of the second insert are shielded by the coupling body extension, the mating end of the first insert being formed into an external tapered conical shape and the coupling body extension of the second coupling body being structured with a mating internal tapered conical opening to receive the mating end of the first insert therein with a snap-fit sealed connection, the mating end faces of the two inserts contacting and sealing together due to the resilient material of the inserts.

8. The multi-circuit connector of claim 7 wherein the second insert further comprises a protruding finger having a tapered conical shape extending from the mating face of the second inserts the protruding finger being longer than the protruding connecting ends of the contact elements of the second insert to shield the protruding connecting ends and shorter than the coupling body extension, and the first insert is provided with a mating tapered conical opening in the mating face of the first insert, the mating tapered conical opening adapted to receive the protruding finger with a self-sealing fit therein.

9. The multi-circuit connector of claim 8 wherein the protruding finger further comprises an opening therein extending through the second insert and the mating conical opening of the first insert further comprises a smaller extension opening through the first insert and further comprising a pair of mating contact elements snap-fit with a self-sealing connection within the finger opening and mating conical opening extension opening.

10. The multi-circuit connector of claim 1 wherein each of the insert passages is provided with an undersized opening hole in the insert passage, a shoulder at a distal end of the insert passage, and a larger opening past the shoulder, and each of the contact elements is provided with an annular ridge capable of engaging the protruding shoulder of the appropriate insert passage upon full insertion to prevent the contact element from being pulled out of the insert passage by the force of the contact elements being disconnected, and at least one annular protruding rearwardly angled barb larger in diameter than the undersized opening hole of the insert passage, so that the contact element is capable of being inserted with a forced fit through the undersized opening hole creating a seal therebetween, and a front rearwardly angled barb which is capable of snap fitting into the larger opening upon complete insertion of the contact within the insert, so that a tactile and audible feedback of complete insertion is provided.

11. The multi-circuit connector of claim 1 wherein at least one coupling body of the pair of coupling bodies has an inline circuit connecting end for receiving a circuit therein, the coupling body inline circuit connecting end comprising a tapered frustoconical surface having a series of annular barb-type ridges protruding therefrom and a circuit opening to admit the circuits therein; and further comprising a strain relief of flexible material having a circuit opening therethrough to admit circuits, the strain relief structured with an internal mating tapered frustoconical surface having mating annular barb-type ridges radiating inwardly so that when the strain relief is snap fit onto the coupling body inline circuit connecting end, the mating barb-type ridges interlock to secure the strain relief to the coupling body with a self-sealing interconnection.

12. The multi-circuit connector of claim 11 wherein the circuits are contained within a cable and the strain relief further comprises a series of resiliently compressible labyrinth-type ridge seals within the circuit opening, the ridge seals capable of being compressed by the cable to form a seal therebetween.

13. The multi-circuit connector of claim 1 wherein one coupling body of the pair of coupling bodies has a panel mount end having an exterior threaded surface to receive a securing nut, and the insert of the one coupling body further comprises an annular peripheral end flange extending beyond the end of the one coupling body, and further comprising a potting cup of flexible material having an interior annular groove adjacent to an attaching end of the potting cup to receive and mate in a sealed connection with the annular peripheral end flange of the insert with the potting cup snap fit onto the insets, the potting cup having an opening at an opposite end to receive circuits therethrough and an interior hollow space which may be filled with a sealer.

14. The multi-circuit connector of claim 1 wherein the coupling body is provided with a circuit opening end to admit the circuit therein and the coupling body is formed of a conductive material so that the coupling body is capable of receiving a shielded cable attached to the circuit opening end during assembly to create a completely shielded composite connector that may be cost effectively fabricated and is shielded against electromagnetic interference and radio frequency interference.

15. The multi-circuit connector of claim 1 wherein the coupling body is provided with a circuit opening end to admit the circuit therein and the coupling body is plated with a conductive material so that the coupling body is capable of receiving a shielded cable attached to the circuit opening end during assembly to create a completely shielded composite connector that may be cost effectively fabricated and is shielded against electromagnetic interference and radio frequency interference.

* * * * *